US007736022B2

(12) United States Patent
Jurik

(10) Patent No.: US 7,736,022 B2
(45) Date of Patent: Jun. 15, 2010

(54) MAGNETIC QUICK-CHANGE GOBO CHANGER SYSTEM

(75) Inventor: Pavel Jurik, Postredni Becva (CZ)

(73) Assignee: Robe Lighting S.R.O.

( * ) Notice: Subject to any disclaimer, the term of this patent is extended or adjusted under 35 U.S.C. 154(b) by 0 days.

(21) Appl. No.: 11/978,979

(22) Filed: Oct. 30, 2007

(65) Prior Publication Data

US 2009/0109681 A1 Apr. 30, 2009

(51) Int. Cl.
*F21V 17/00* (2006.01)
*F21V 21/00* (2006.01)

(52) U.S. Cl. ..... 362/283; 362/322; 362/398; 359/903

(58) Field of Classification Search ..... 359/827, 359/892, 903; 353/84, 97; 362/283, 284, 362/293, 322, 324, 398, 433, 434, 457, 458
See application file for complete search history.

(56) References Cited

U.S. PATENT DOCUMENTS 5,371,663 A * 12/1994 Chuang ..... 362/280
5,691,886 A * 11/1997 Stacy ..... 362/283
6,971,770 B2 * 12/2005 Rasmussen et al. ..... 362/293
7,222,997 B2 * 5/2007 Rasmussen et al. ..... 362/398

* cited by examiner

*Primary Examiner*—Thomas M Sember

(57) ABSTRACT

For lighting equipment for illumination of theatre and show stages and platforms there is designed an equipment for change of rotary gobos comprising a carrier disc supporting interchangeable segments with the gobos. The individual segments (2) are attached at the carrier disc (1) by central holding means, each segment (2) being provided with means for setting the segment (2) on the carrier disc (1). Each segment (2) is provided with a lamella (3) for attachment by the magnetic holding means. The magnetic holding means comprise a magnet (24) in attracted to a ferrous plate (23) attached to the carrier disc (1).

1 Claim, 7 Drawing Sheets

MAGNETIC QUICK-CHANGE GOBO CHANGER SYSTEM

TECHNICAL FIELD OF THE INVENTION

The invention relates to equipment for a change of rotary gobos furnished with a carrier disc supporting interchangeable segments with the gobos.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will typically provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The products manufactured by Robe Show Lighting such as the ColorSpot 1200E are typical of the art.

One device commonly found in automated luminaries are gobo wheels. The expression gobo relates to an image which is to be projected as a slide within a comparatively great distance. Due to a high temperature of the respective light source such an image is typically created on a metal, glass or any suitable base. To increase the achieved effect the gobos rotate, as a moving image attracts more attention than a stationary image. Rotary gobos need not rotate continuously, therefore their rotation depends upon activation of a drive motor. Typically these systems are configured on a circular carrier with a central sun gear surrounded by planetary gears which rotate the gobo when the sun gear rotates. The figures described below illustrate the planetary gears but not the sun gear. In some such systems the planetary gears are rotated by a gear on the periphery of one or more of the planetary gears. In some such systems gears are not employed at all, the rotation is accomplished by friction or belts. In other systems a combination of belts and gears are used.

Generally speaking there exist two basic types of changeable gobo rotary gobo systems, which are applied with minor or major divergences. By the first system, gobos are placed on a carrier disc and the gobos themselves are exchanged. Such a system is technologically simple and cheap, but from a practical point of view it is very cumbersome. In general a lighting equipment designs offer very little working space for any manipulation and often, special tools are necessary. This simple design is used preferably for cheap equipment.

In the second type of system, the carrier disc is furnished with mutually independent segments, one segment for each gobo. In order to change the gobo in these systems complete segments are exchanged. In most cases each segment has a special bearing with grooves matching with counter-pieces on the carrier disc. The design of these systems is very demanding on manufacturability of the system. It is an object of the invention to simplify the design of attachment of gobos at the carrier disc and to simplify and speed up gobo changing procedures.

The foregoing problems are solved by equipment design for a rotary gobos drive comprising a carrier disc supporting interchangeable gobo holding segments in accordance with the present invention. The individual segments being attached at the carrier disc by central holding means, each segment being provided with means for in a non-fixed manner registering the position of the segment on the carrier disc. Further in accordance with the present invention each segment may be provided with a lamella for attachment in the central holding means. In a preferred embodiment the central holding means comprise a system of flexible fingers in a fan-shaped arrangement. The fingers are at inside ends fixed to the carrier disc and on the outside free ends adapted to allow for insertion of the segment lamellas between the fingers and the carrier disc. The fingers may be at their inside ends integrated into one unit. The number of fingers within the unit corresponds to a number of segments to be supported by the carrier disc. Still further in accordance with the invention each segment is provided with a bearing supporting a driver with a gobo. The bearing inside ring is provided for by the driver outer rim and the bearing outside ring is attached to the segment lamella by dismountable connection means. The driver further comprise a flange with a spur toothing, designed for engaging with a mechanism for rotation of the gobos. Dismountable connection means for attachment of the bearing outer ring on the lamella may be preferably utilized as means for attaching the segment on the carrier disc. The carrier disc may be further provided with circular apertures allowing for lighting of gobos, the apertures having their centers located at a common pitch circle and being along own perimeter provided with means for engaging with means for registering the position of the segments on the carrier disc.

According the first aspect of the invention provides a simple seating of a segment with gobos on the carrier disc and for changing of the gobos in a very simple and easy procedure. According to another aspect of the invention the presented solution is also technologically simple with little manufacturing costs.

BRIEF DESCRIPTION OF THE DRAWINGS

By way of examples the invention will be now described with reference to the accompanying drawing. On FIG. 1 there is presented an axonometric view from above on a carrier disc with seven segments, one of which is in an outside position and FIG. 2 show and an axonometric view from underneath on the carrier disc according to FIG. 1.

DESCRIPTION OF PREFERRED EMBODIMENTS

Figure 1:
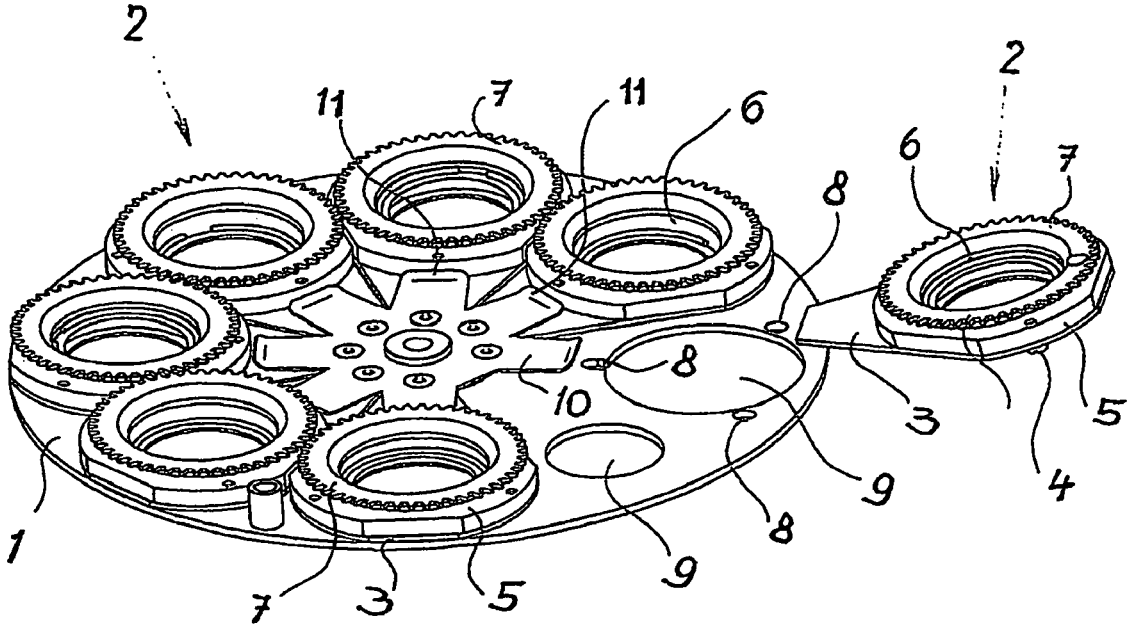

FIG. 1 illustrates equipment for a change of rotary gobos comprising a carrier disc 1 on which there are arranged interchangeable segments 2 with gobos mounted thereon. On all accompanying drawings gobos are presented simply as blank fields. In the embodiment presented on FIG. 1 the carrier disc 1 is equipped with seven segments 2 and one free position, which serves for direct illumination by light.

All segments 2 are by central holding means 10 attached at the carrier disc 1. A part of each segment 2 is made of a lamella 3, shaped for attachment of the segment 2 in the central holding means 10. The gobo is fixed in a rotating gobo carriage driver 6 seated in ball bearing. Fixed connection means, like screws 4 with cylindrical head in the depicted embodiment, serve for securing a ball bearing outside ring 5 on the lamella 3 of each segment 2. The bearing balls are freely located in the bearing outside ring 5, while the bearing inside ring is provided for by a driver 6 outer rim. The driver 6 seating is thus of a very simple design when compared with a standard ball bearing arrangement, nevertheless the function of a rotary gobo is fully retained. The driver 6 is provided with a flange 7 having a spur toothing for engagement with a mechanism for rotation of the gobos.

The carrier disc 1 is provided with apertures 9, the centers of which are placed on a common pitch circle. The apertures 9 allow for a light beam to go through the gobos or just through the carrier disc 1, as the case may be.

Figure 2:
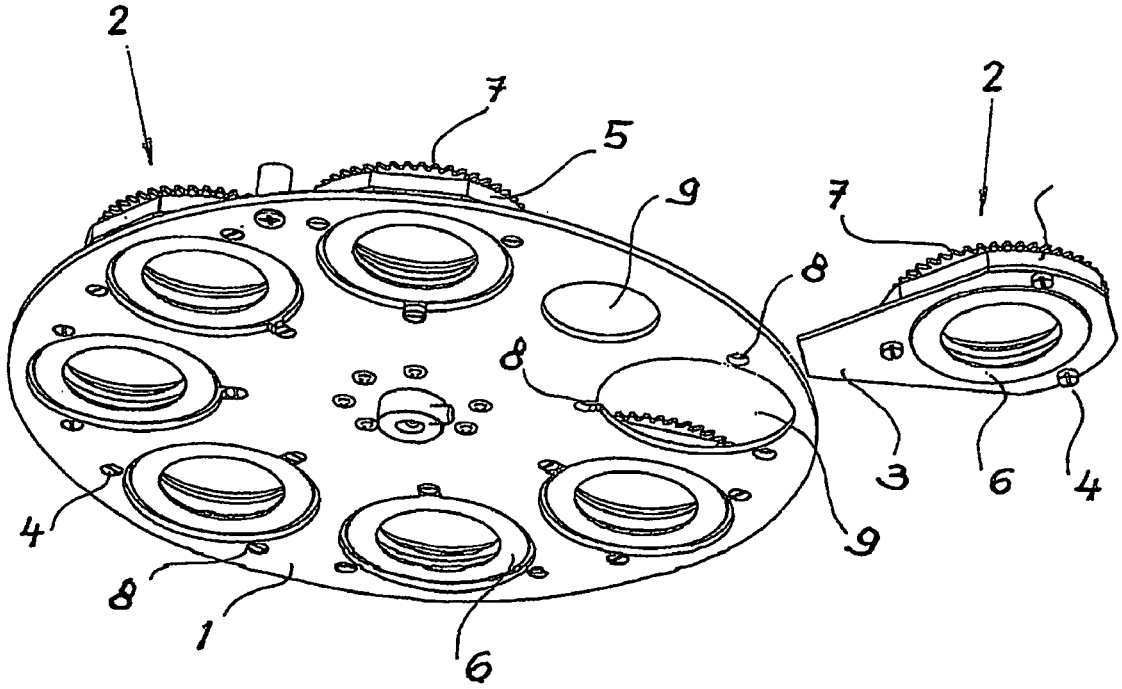
Figure 3:
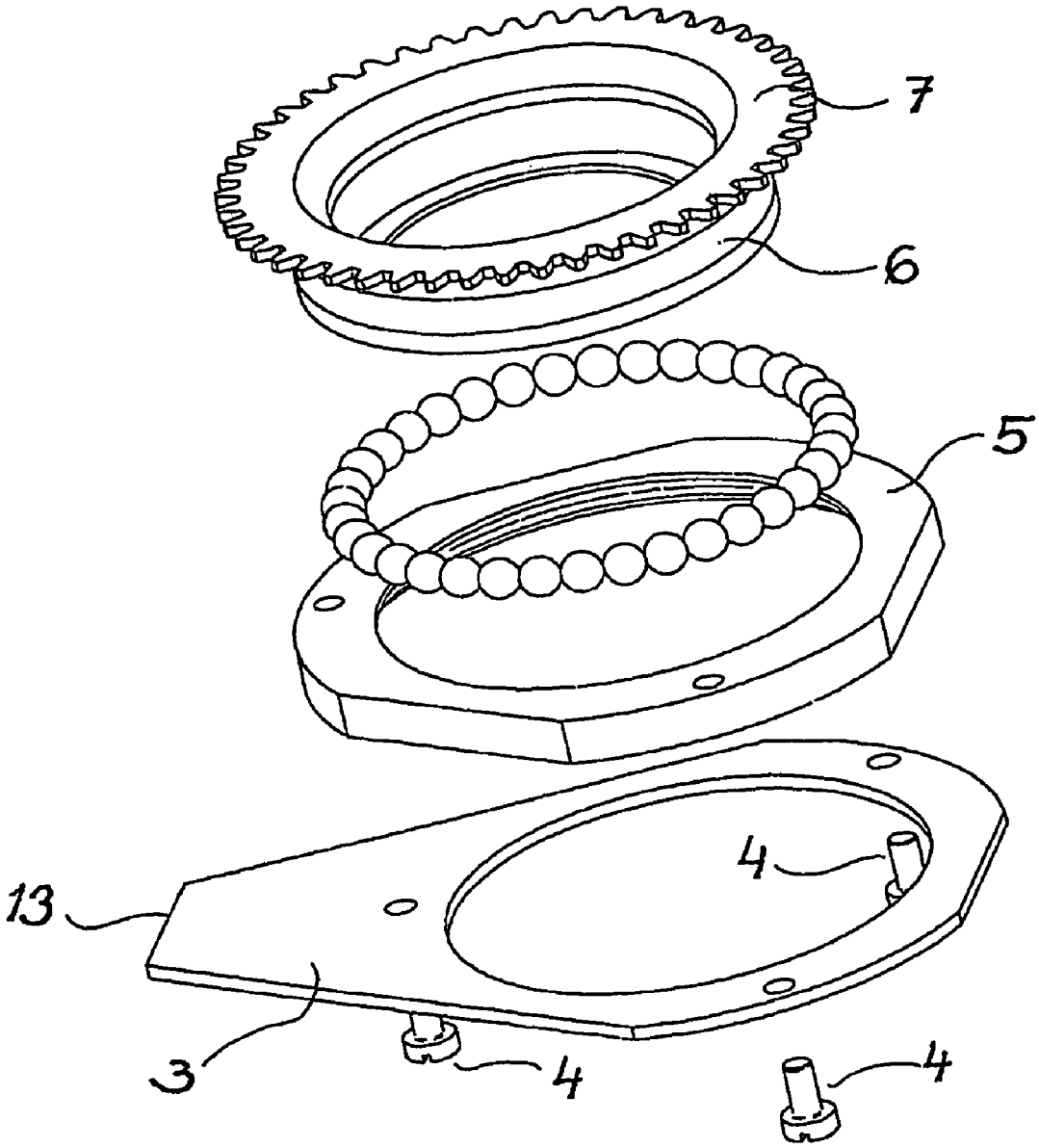
FIG. 3 is an axonometric view on one segment in a disassembled state.

Each segment 2 is provided with means for registering the position of a segment 2 on the carrier disc 1. Preferably the means for registering the position of a segment 2 on the carrier disc 1 are provided for by the bearing connection means 4 for attachment of a ball bearing outside ring 5 on the lamella 3. In the discussed embodiment the means for registering the position of a segment 2 on the carrier disc 1 are provided for by the cylindrical heads of the screws 4. To achieve a proper position of the segment 2 on the carrier disc 1 the screw 4 heads match with recesses 8 made along a perimeter of respective aperture 9 in the carrier disc 1. In the embodiment shown on FIG. 1 and FIG. 2 there are used three screws 4 for each segment 2 and therefore each aperture 9 has three recesses 8 distributed along its perimeter and spaced apart with respect to distribution of the screws 4. There may be used a different number of the screws 4, but basically two of them are sufficient. Instead of the above described construction the means for registering the position of a segment 2 on the carrier disc 1 may be provided for also by another means known as such.

Figure 4:
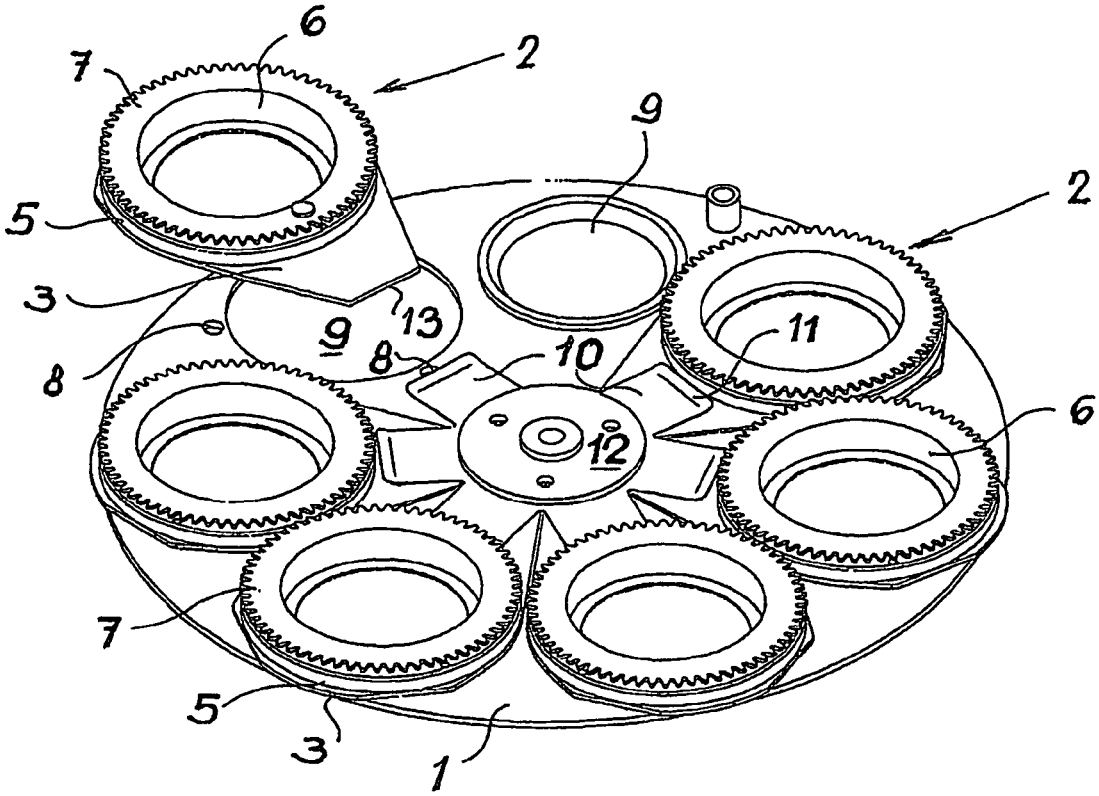
FIG. 4 presents an axonometric view on a carrier disc supporting six segments and FIG. 5 represents an axonometric view on a carrier disc with five segments.
Figure 5:
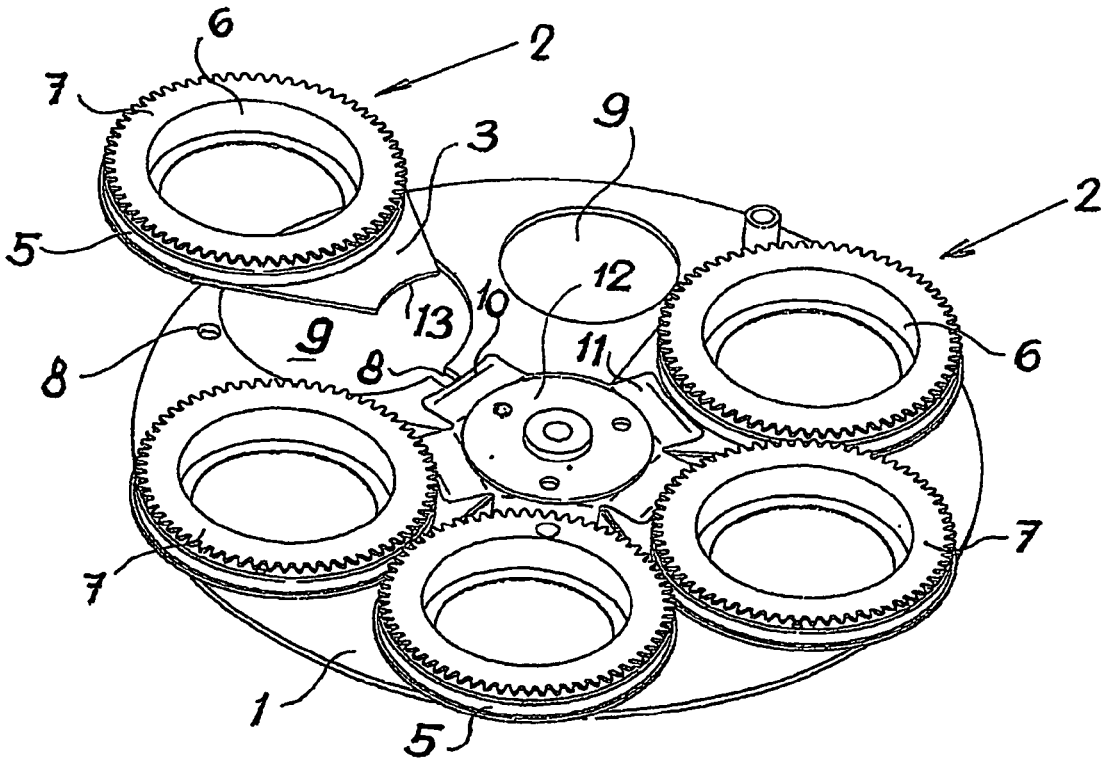

The central holding means 10 comprise a system of radially extending flexible fingers 10 in a fan-shaped arrangement. The fingers 10 are at inside ends attached to the carrier disc 1, preferably by rivets, and on the outside free ends 11 bent upwards to facilitate insertion of segment lamellas 3 between the fingers 10 and the carrier disc 1 body. The number of fingers 10 corresponds to the number of the segments 2, but it is possible for one finger 10 to secure position of more than one segment 2. Preferably the inside ends of all the fingers 10 are integrated into one piece. In a place corresponding to a free position on the carrier disc 1 there is no finger 10 and the space is kept free. To improve pressing forces produced by the central holding means upon the segment 2 lamellas 3 the fingers 10 may be provided with a pressure disc 12 located in their central part common for all the fingers 10, as presented on FIG. 4 and FIG. 5.

To further facilitate insertion of the segment lamella 3 under the finger 10 of the carrier disc 1 one of the recesses 8 is carried out in such a way, that a center of such a recess 8 is located at a radial going through the carrier disc 1 center, as it is performed by the embodiments illustrated in FIGS. 1, 2, 4 and 5. By a larger number of segments 2, usually seven and more, the driver 6 outside contour edges are cut off, as shown on FIG. 1 and FIG. 2. By a small number of the segments 2, the inside edge 13 of the lamella 3 is of an arc shape for a better fit under the central holding means.

Figure 6:
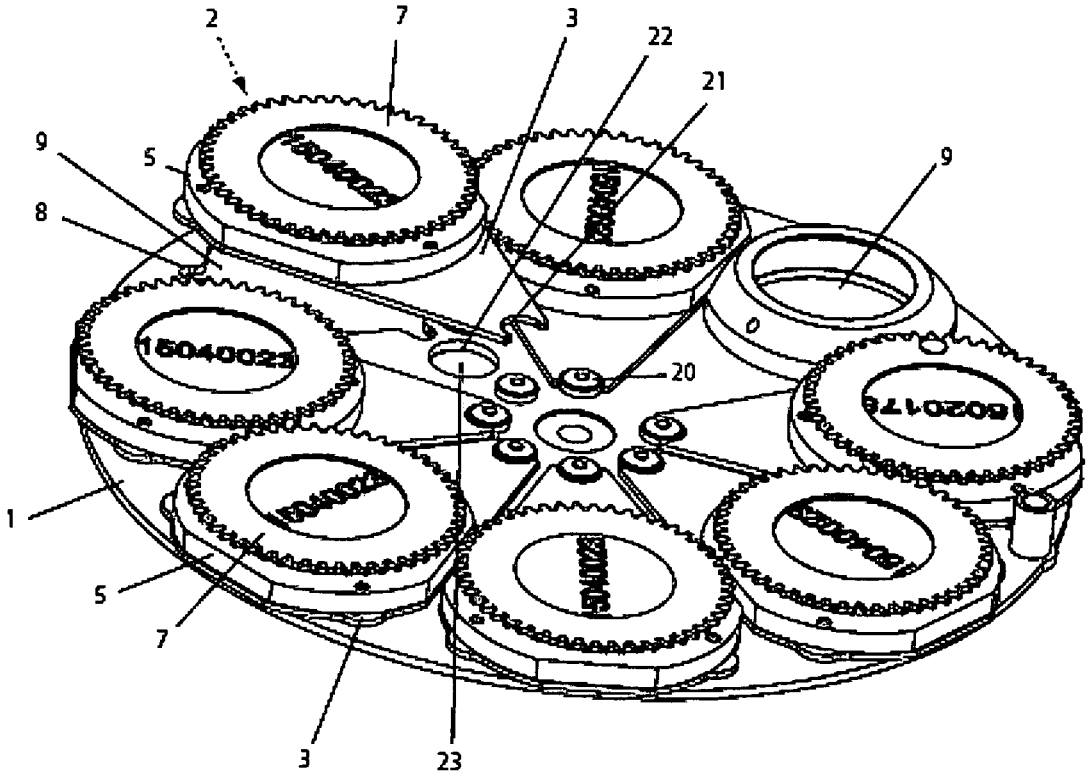
FIG. 6 is an axonometric view of a further embodiment.
Figure 7:
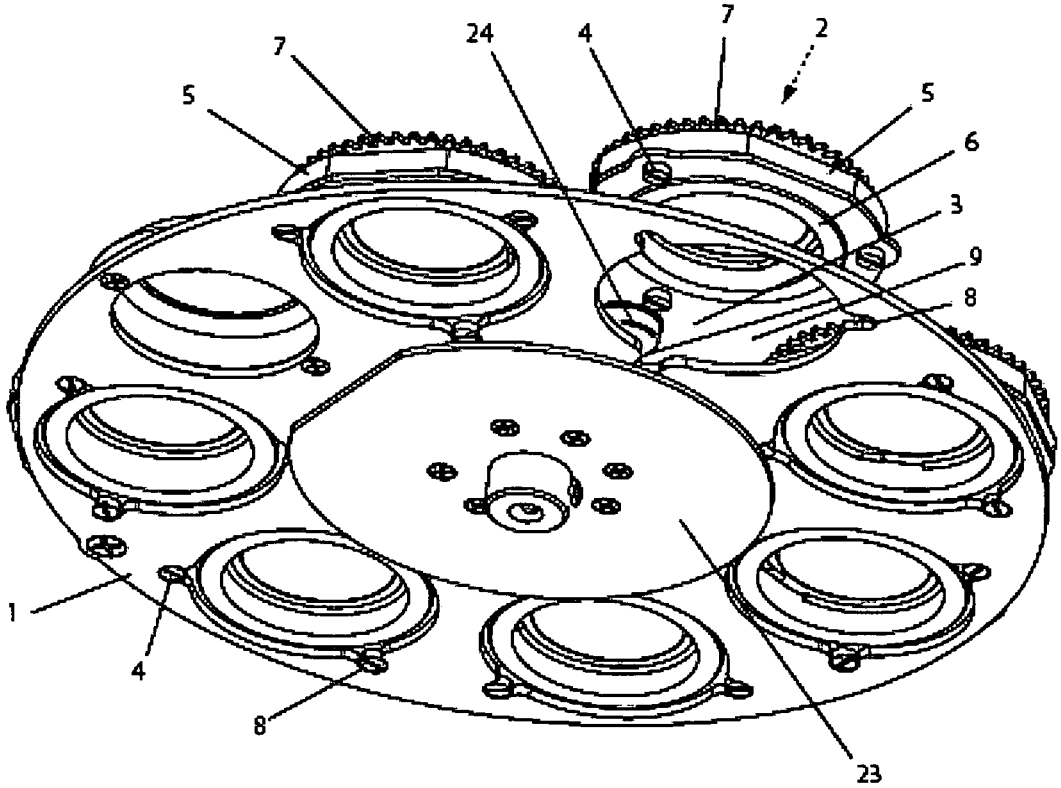
FIG. 7 is an axonometric view from underneath the carrier disc shown in FIG. 6.

FIG. 6 and FIG. 7 illustrate another embodiment of the invention where the retention of the segment onto the carrier is achieved through magnetic attraction. FIG. 6 provides a top perspective view and FIG. 7 Provides a bottom perspective view. The segment 2 is made of a lamella 3, shaped for registration and attachment of the segment 2 by a magnetic holding means 24. The gobo is fixed in a driver 6 seating in ball bearing. Bearing connection means, like screws 4 with cylindrical head in the depicted embodiment, serve for securing a ball bearing outside ring 5 on the lamella 3 of each segment 2. The bearing balls are freely located in the bearing outside ring 5, while the bearing inside ring is provided for by a driver 6 outer rim. The driver 6 is provided with a flange Z having a spur toothing for engagement with a mechanism for rotation of the gobos.

The bearing connection screws serve a second function: to register the position of the segments when installed on a carrier disc. It is important to note that these screws do not hold the segments to the carrier disc. To achieve a proper position of the segment 2 on the carrier disc 1 the screw 4 heads match with recesses 8 made along a perimeter of respective aperture 9 in the carrier disc 1 together serving to register the position of the segment on the carrier. In the embodiment shown on FIG. 6 and FIG. 7 there are three registration screw heads 4 for each segment 2 and therefore each aperture 9 has three recesses 8 distributed along its perimeter and spaced apart with respect to distribution of the registration screw heads 4. There may be used a different number of the registration screw heads 4, but basically two are sufficient. Instead of the above-described construction the means for registering a segment 2 on the carrier disc 1 may be provided for also by another means known as such—for example pegs or slots and nonconcentric inserts.

The magnetic holding means comprise a ferrous plate 23 mounted underneath the carrier plate 1 with a hole 22 in the carrier plate 1 exposing a portion of the ferrous plate 23. Carrier plate 1 is typically constructed of a non ferrous non-magnetic material such as aluminum. In addition alignment pins 20 are attached to carrier plate 1. In the embodiment shown, the number of alignment pins 20 and holes 22 corresponds to the number of segments 2. Further the segment 2 has a magnet 24 mounted underneath the lamella 3 such that the magnet passes through the hole 22 in the carrier plate 1 and attaches to the ferrous plate 23. The magnetic attraction between magnet 24 and ferrous plate 23 securely retains the segment in position on the carrier. Magnet 24 may be of the same size and shape as the hole 22 such that there is a close alignment between the magnet 24 and the hole 22. In an alternate embodiment magnet 24 is smaller than hole 22 such that alignment screws 4 provide alignment of the segment by engaging in recesses 8. Magnet 24 may be a rare earth magnet or constructed of other magnetic material well known in the art. Lamella 3 may have an indentation 21 at its inner end which serves to engage with alignment pin 20 and assist with the positioning and alignment of the segment onto the carrier.

Figure 8:
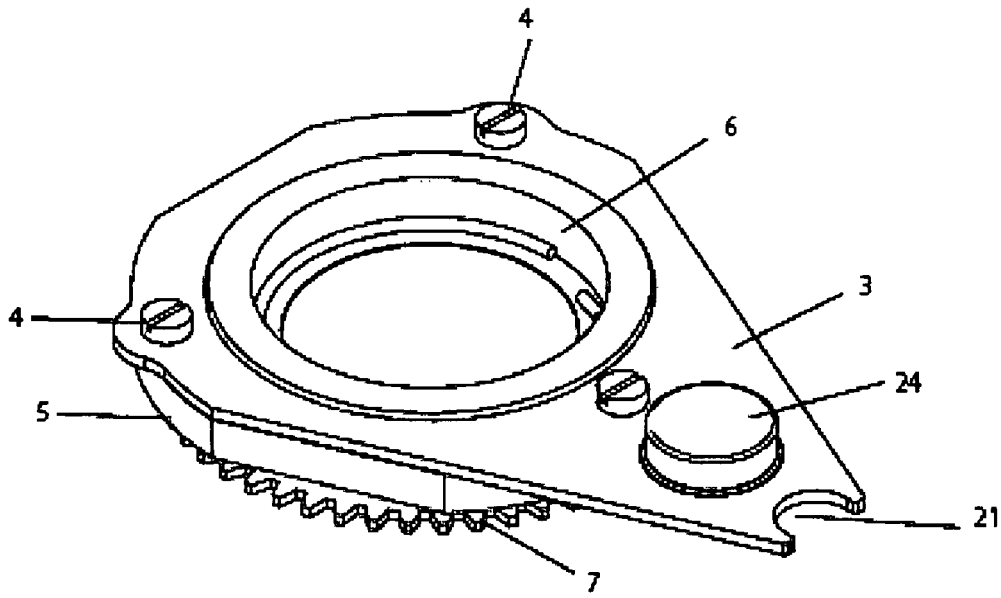
FIG. 8 is an axonometric view of a single removable segment with the rotating gobo carriage mounted thereto.
Figure 9:
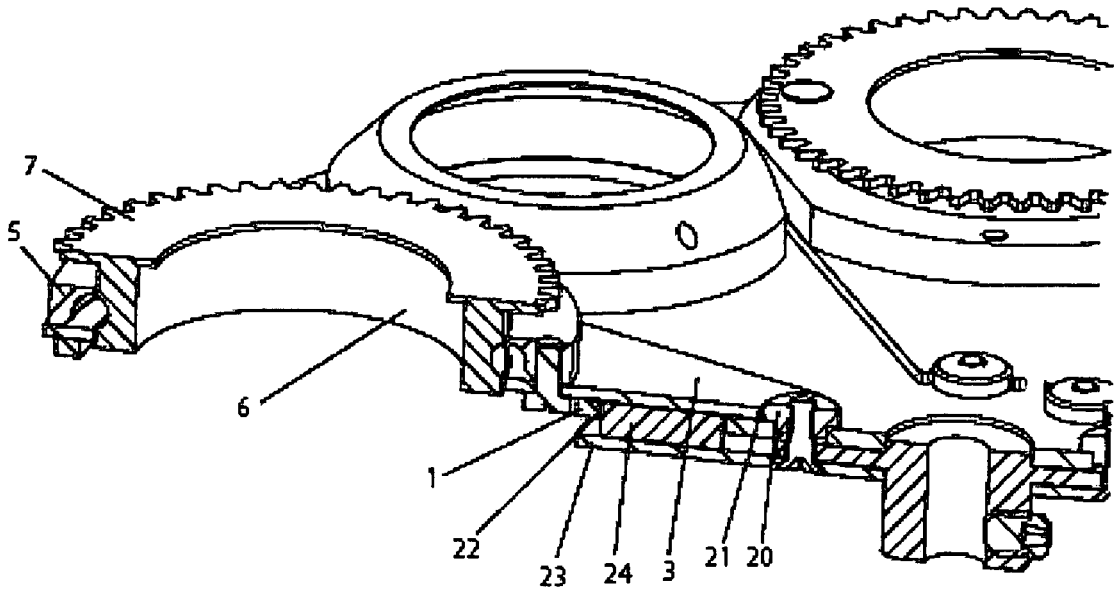
FIG. 9 is a cross section of a segment and the carrier.
Figure 10:
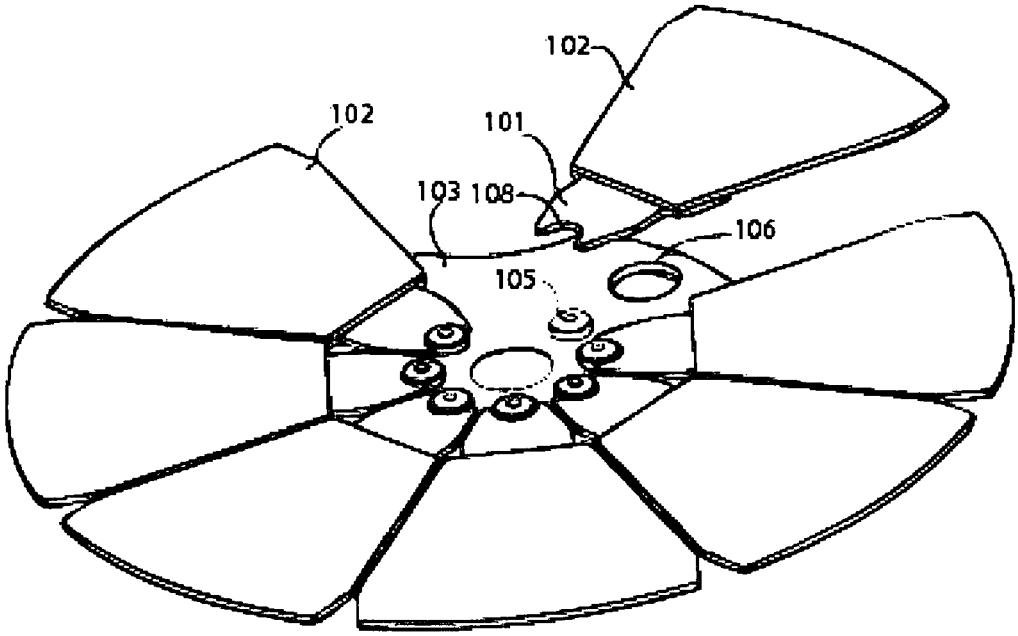
FIG. 10 is an axonometric view of a further embodiment
Figure 11:
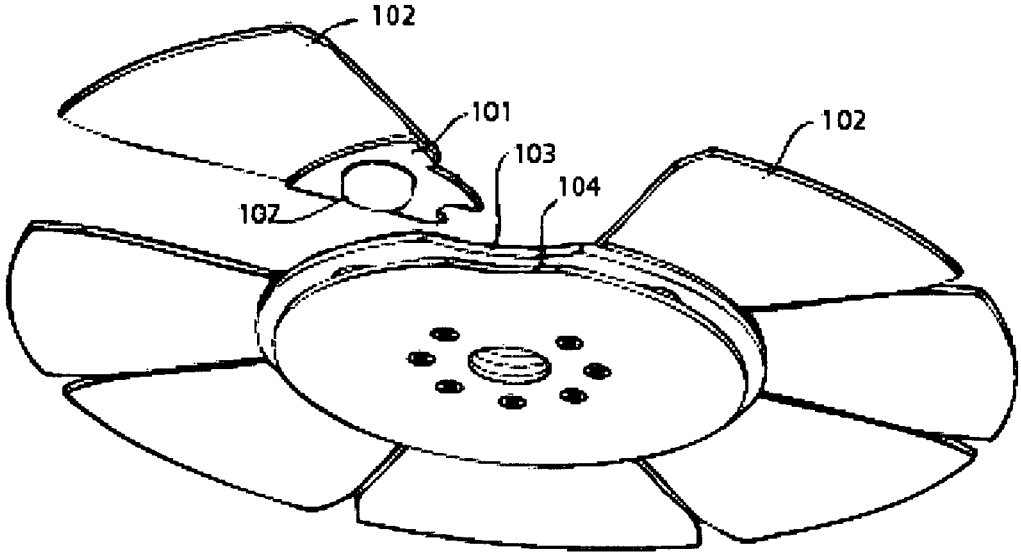
FIG. 11 is an axonometric view from underneath the carrier disc shown in FIG. 10.
Figure 12:
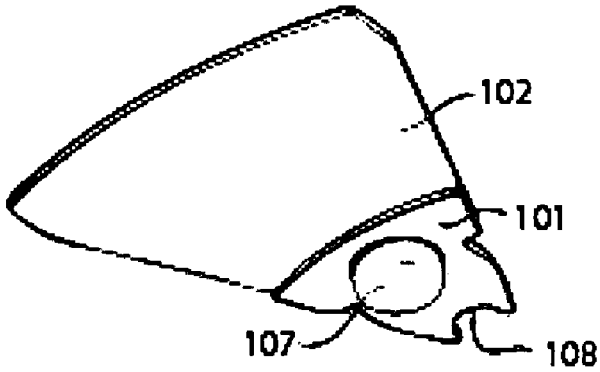
FIG. 12 is an axonometric view of a single removable segment.
Figure 13:
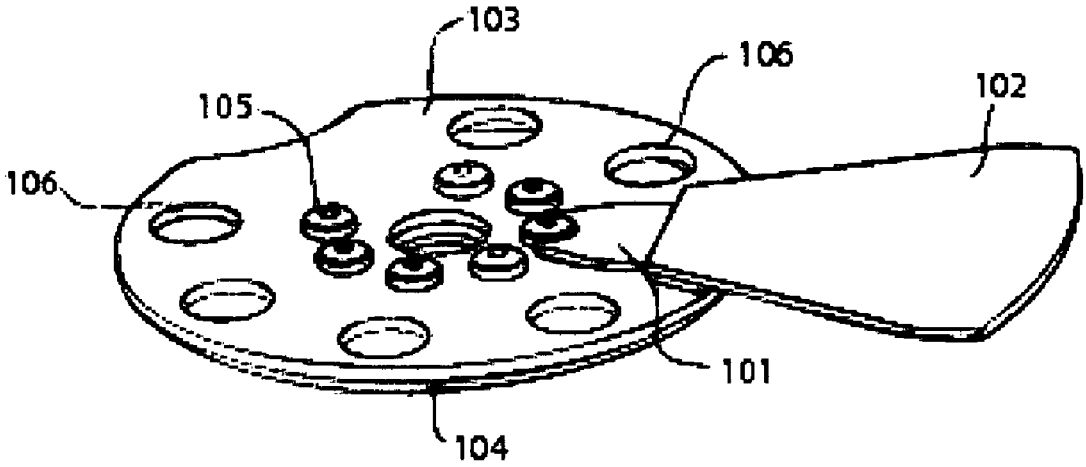
FIG. 13 is an axonometric view of a single segment mounted on the carrier disc

FIG. 8 illustrates the detail of the underneath of a single segment with its lamella 3, position registration screw heads 4, magnet 24 and alignment indentation 21. FIG. 9 is a cross section through the assembly showing how the magnet 24 passes through the hole 22 in the carrier plate 1 to engage with the ferrous plate 23.

FIGS. 10, 11 12 and 13 illustrate a yet further embodiment of the invention. In this variant the segments do not carry gobos but instead carry filter material or other optical device such as lenses, frost or effects glasses. The filter material may be dichroic glass, colored glass or other colored material well known in the art. Filter material 102 is attached to lamella 101 which, in turn, has a magnet 107 attached to its underside. The main carrier plate 103 has a series of holes 106 through which the magnets 107 can pass and attach to the ferrous plate 104 which is affixed to carrier plate 103. The lamella 101 may have an indentation 108 at its inner end which serves to engage with alignment pin 105 and assist with the positioning and alignment of the segment onto the carrier. This system has the further distinction of not requiring a full size carrier plate 103. This allows the filter material segments 102 to be mounted adjacent to one another with no frame or border between adjacent segments. The alignment provided by indentation 108 and alignment pin 105 is adequate for this requirement.

It should be appreciated by those skilled in the art that the quick-change gobo changer systems described above can be changed without removing the gobo carrier from the automated luminaire without handling the gobos directly and without the use of tools and can be done very quickly by hand.

INDUSTRIAL APPLICATIONS

The present invention is designed for lighting equipment, especially for illumination of theatre and show stages and platforms etc.

While the invention has been described with respect to a limited number of embodiments, those skilled in the art, having benefit of this invention, will appreciate that other embodiments may be devised which do not depart from the scope of the invention as disclosed herein. Accordingly, the scope of the invention should be limited only by the attached claims.

The invention has been described in detail, it should be understood that various changes, substitutions and alterations can be made hereto without departing from the spirit and scope of the invention as described by the appended claims.

What is claimed is:

1. An automated luminaire with a rotating gobo system comprising:

a carrier for simultaneously holding a plurality of interchangeable segments each segment carrying at least one gobo in a rotating gobo carriage where the segments are held to the carrier by magnetic force; and an alignment mechanism for positioning and maintaining the alignment of each of the segments on the carrier.

* * * * *